US005358345A

United States Patent [19]

Damitio

[11] Patent Number: 5,358,345

[45] Date of Patent: Oct. 25, 1994

[54] PRINTER OUTFEED PAPER COLLECTOR FOR REFOLDING AND RESTACKING FANFOLD PAPER DISCHARGED FROM A CONTINUOUS FORM PRINTER OR THE LIKE

[75] Inventor: Stephen S. Damitio, Veradale, Wash.

[73] Assignee: Output Technology Corporation, Spokane, Wash.

[21] Appl. No.: 197,080

[22] Filed: Feb. 16, 1994

[51] Int. Cl.[5] ..... B41J 15/00; B31B 1/00

[52] U.S. Cl. ..... 400/613.2; 493/410; 493/422; 400/613.3; 400/619

[58] Field of Search ..... 400/613, 613.2, 613.3, 400/619, 642, 646; 226/196; 346/136; 493/409–416, 422, 423, 424, 434, 435, 451, 454, 460, 461

[56] References Cited

U.S. PATENT DOCUMENTS

| | | | |
|---|---|---|---|
| 1,985,676 | 12/1934 | Hand | 493/359 |
| 2,495,994 | 1/1950 | Ward et al. | 493/413 |
| 3,124,350 | 3/1964 | Huffman | 493/414 |
| 3,547,430 | 12/1970 | Assony | 493/414 |
| 3,904,186 | 9/1975 | DeLigt | 493/422 |
| 3,912,252 | 10/1975 | Stephens | 493/414 |
| 4,054,235 | 10/1977 | Witcher | 226/200 |
| 4,141,660 | 2/1979 | Bommersheim et al. | 400/124 |
| 4,151,985 | 5/1979 | Gladow | 493/414 |
| 4,226,410 | 10/1980 | McIntosch, Sr. et al. | 493/410 |
| 4,332,581 | 6/1982 | Thompson | 493/413 |
| 4,494,948 | 1/1985 | Teyssier, Jr. | 493/11 |
| 4,508,427 | 4/1985 | Uno et al. | 493/357 |
| 4,530,689 | 7/1985 | Ringer, Sr. | 493/410 |
| 4,631,552 | 12/1986 | Kobayashi | 346/136 |
| 4,696,591 | 9/1987 | Boyden | 400/613.2 |
| 4,707,156 | 11/1987 | Clark | 400/613.2 |
| 4,717,273 | 1/1988 | Elderfield | 400/613.2 |
| 4,722,506 | 2/1988 | Chang | 248/676 |
| 4,743,131 | 5/1988 | Atwell | 400/613.2 |
| 4,749,295 | 6/1988 | Bankier et al. | 400/613.2 |
| 4,820,250 | 4/1989 | Bunch, Jr. | 493/414 |
| 4,894,668 | 1/1990 | Ozawa et al. | 346/136 |
| 4,917,657 | 4/1990 | Bunch, Jr. | 493/8 |
| 4,976,677 | 12/1990 | Siversson | 493/413 |
| 5,029,828 | 7/1991 | Sato et al. | 493/454 X |
| 5,082,382 | 1/1992 | Negoro et al. | 400/613.2 |
| 5,123,890 | 6/1992 | Green, Jr. | 493/357 |
| 5,123,894 | 6/1992 | Bergeman et al. | 493/410 |
| 5,149,075 | 9/1992 | Crowley et al. | 270/39 |
| 5,226,742 | 7/1993 | Pintar et al. | 400/583.4 |
| 5,238,316 | 8/1993 | Moore et al. | 400/613.2 |
| 5,248,291 | 9/1993 | DeNoon et al. | 493/410 |
| 5,263,785 | 11/1993 | Negoro et al. | 400/613.2 |
| 5,300,008 | 4/1994 | Lee et al. | 400/613.2 X |

OTHER PUBLICATIONS

Product Brochure, "The ATC M100-A Paper Stacking Solution for Continuous Form Laser Printers", Analog Tech. Corp., 1983.

*Primary Examiner*—Edgar S. Burr
*Assistant Examiner*—Christopher A. Bennett
*Attorney, Agent, or Firm*—Wells, St. John, Roberts, Gregory & Matkin

[57] ABSTRACT

A printer output paper collector 10 is described for refolding and stacking fanfold paper 20 that is discharged from a continuous form printer 12. The collector 10 includes a frame 40 with a base 41, a printer stand section 42 and a restacking section 44. The restacking section 44 has a platform 46 for receiving the discharged paper that is to be restacked. Helical refolding guides 60 and 62 are mounted on vertical shafts 64 and 66 respectively for rotation in opposite directions to initially engage the fanfold paper and to refold the paper and restack the paper. The helical refolding guides 60 and 62 include helical spiral elements 68 and 70 that rotate with the shafts 64 and 66, and are permitted to move vertically to maintain the vertical elements 68 and 70 on top of the restack as it progressively increases in height.

5 Claims, 7 Drawing Sheets

30
14
12
16
32
10
42
24
52
62
70
54
48
41
50
60
68
46
40
3
3

PRINTER OUTFEED PAPER COLLECTOR FOR REFOLDING AND RESTACKING FANFOLD PAPER DISCHARGED FROM A CONTINUOUS FORM PRINTER OR THE LIKE

TECHNICAL FIELD

This invention relates to printer outfeed collectors particularly those concerned with refolding and restacking fanfold paper discharged from a continuous form printer, plotter or the like.

BACKGROUND OF THE INVENTION

Generally, continuous form computer printers or copiers are fed fanfold or zigzag folded paper having a rather long length (continuous form) from a stack. Each panel or sheet of the continuous form is usually defined by transverse perforations or scoring. In the formation of a stack of fanfold continuous form paper, the paper is folded back and forth and creased at the perforations defining alternate fold lines until the desire stack height is obtained. As the paper is being oppositely folded at the perforations or scoring, the paper fibers are given an initial directional fold memory, to facilitate refolding and restacking of the fanfold paper at the original fold lines. Examples of fanfold paper folding devices are illustrated in the following United States patents:

| U.S. Pat. No. | Inventor(s) | Issue Date |
|---|---|---|
| 1,985,676 | Hand | Dec. 24, 1934 |
| 2,495,994 | Ward et al. | Jan. 31, 1950 |
| 3,124,350 | Huffman | Mar. 10, 1964 |
| 3,547,430 | Assony | Dec. 15, 1970 |
| 3,912,252 | Stephens | Oct. 14, 1975 |
| 4,151,985 | Gladow | May 1, 1979 |
| 4,332,581 | Thompson | Jun. 1, 1982 |
| 4,508,527 | Uno et al. | Apr. 2, 1985 |
| 4,820,250 | Bunch, Jr. | Apr. 11, 1989 |
| 4,917,657 | Bunch, Jr. | Apr. 17, 1990 |
| 4,976,677 | Siversson | Dec. 11, 1990 |
| 5,123,890 | Green, Jr. | Jun. 23, 1992 |
| 5,149,075 | Crowley et al. | Sep. 22, 1992 |

However the strength of the directional fold memory of the paper at each fold line is frequently weakened as it passes through the printer, making it difficult for the printer outfeed collector to reform the paper into a neat and orderly stack. The problem is particularly magnified when the fanfold paper is feed through an electrophotographic printer having high temperature fuser rollers. Proposed solutions to this problem have been suggested in the Negoro et al. U.S. Pat. No. 5,082,382, issued Jan. 21, 1992 and the Bergeman et al. U.S. Pat. No. 5,123,894 issued Jun. 23, 1992, along with other patents classified in U.S. Class 400, subclass 613.2.

Advanced Technology Corporation of Duarte, Calif., is presently selling opposed moving belt devices under the brand name "Paper Cat", that are mountable along the sides of a printer outfeed collector with belt-teeth to engage and move the fold lines downward to assist in refolding fanfold paper discharged from the printer.

Although such prior art devices may assist in refolding and restacking fanfold paper, they are either too expensive or are only moderately successful.

One of the advantages of the present invention is that it is rather inexpensive and quite reliable and effective in both refolding and restacking fanfold paper discharged from the output of a computer printer.

These and other objects and advantages of the present invention will become apparent in reviewing the following detailed description of a preferred embodiment.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
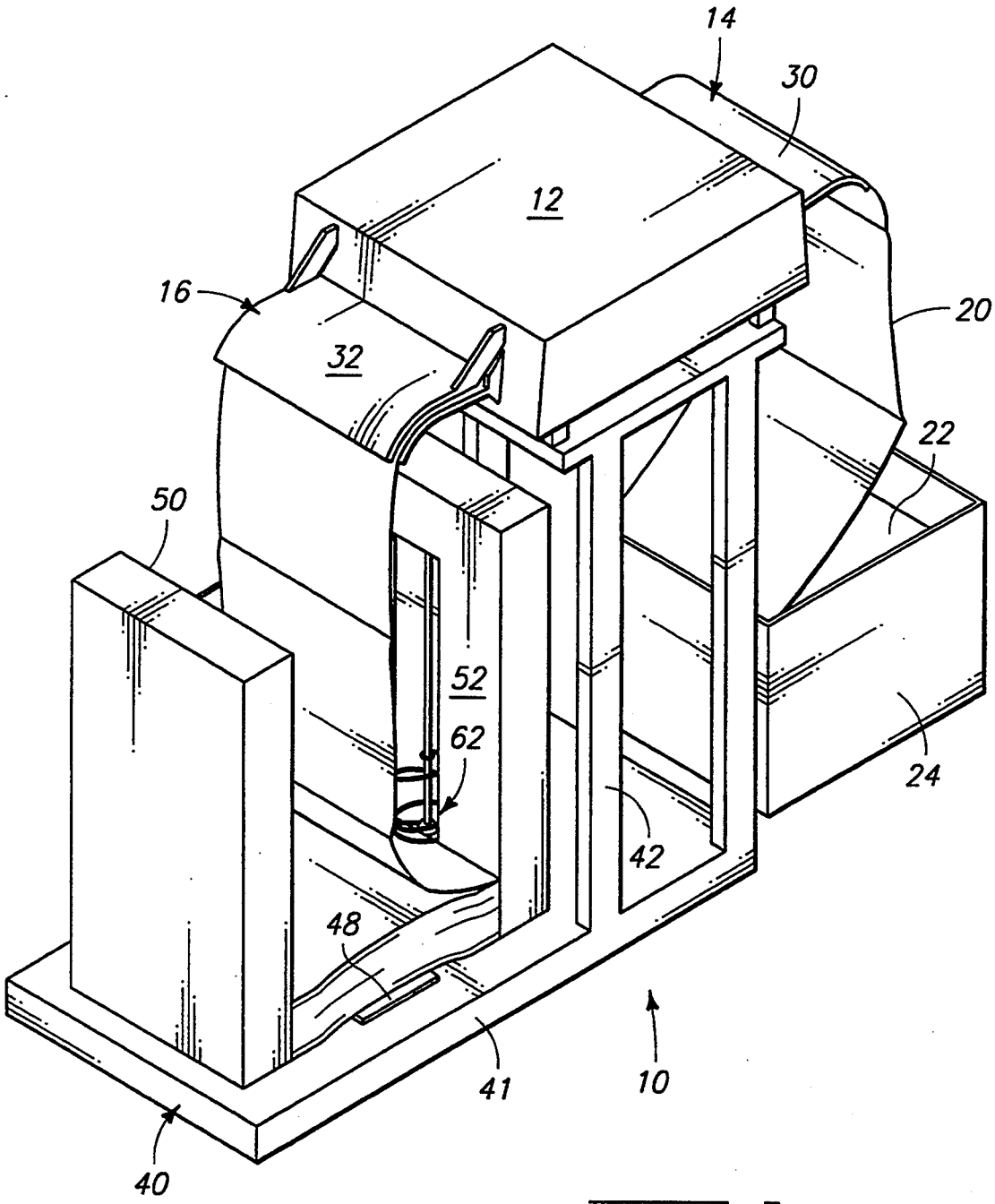
FIG. 1 is an isometric view of a preferred embodiment of the printer outfeed collector, illustrating fanfold paper being discharged from an outlet of a printer and into the collector.
Figure 2:
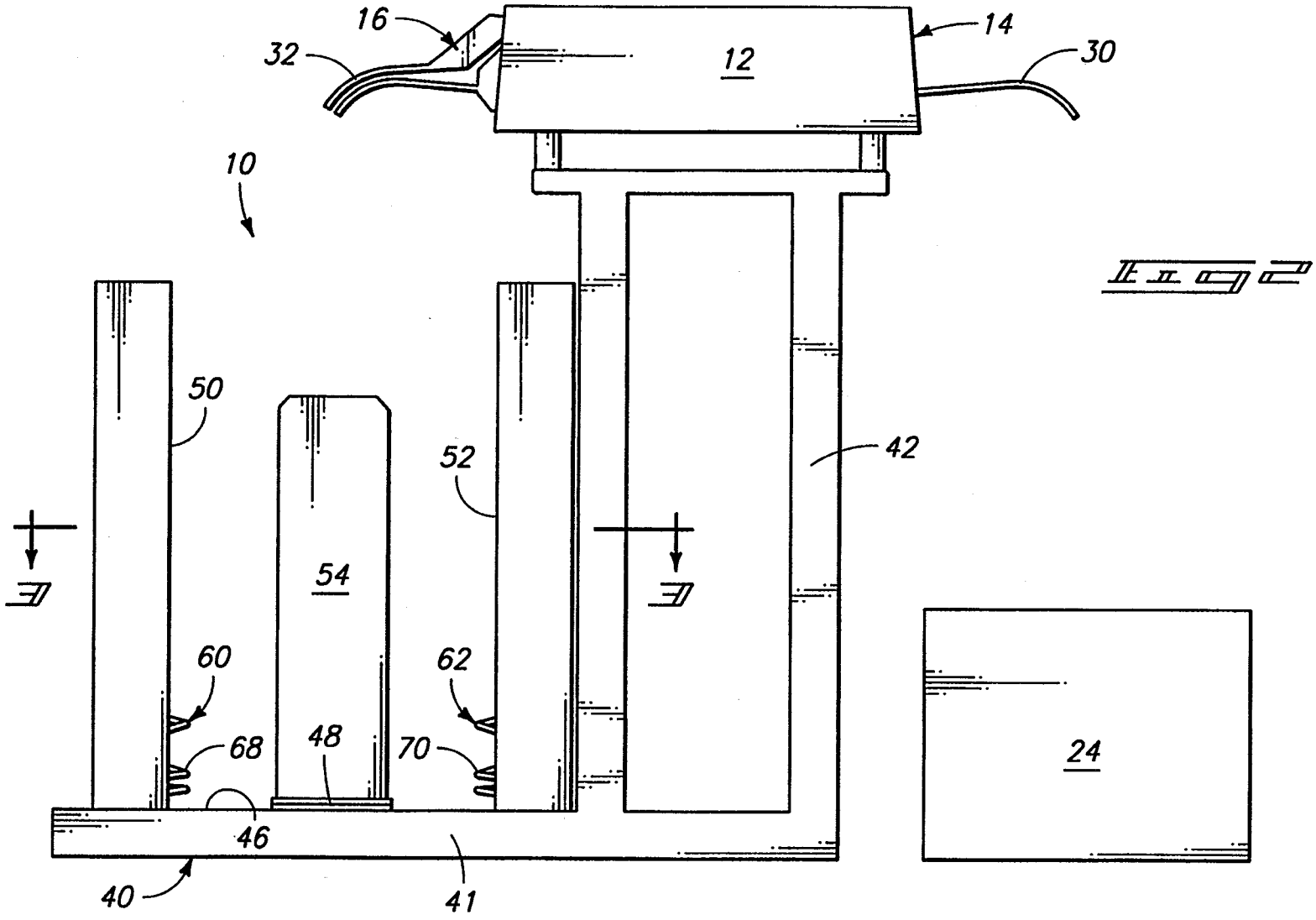
FIG. 2 is a side elevational view of the printer outfeed collector illustrated in FIG. 1.

This disclosure of the invention is submitted in furtherance of the constitutional purposes of the U.S. Patent Laws "to promote the progress of science and useful arts"(Article 1, Section 8).

A printer output paper collector, generally designated with the numeral 10, is illustrated in the accompanying drawings. The collector 10 is designed to operate in conjunction with a continuous form printer 12 that has a paper input section 14 and a paper output section 16. Preferably the continuous form printer 12 is an electrophotographic printer.

The collector 10 is designed to refold and restack fanfold or zigzag paper 20 that is discharged from the output section 16 of the printer 12. The fanfold paper 20 is initially stored in a stack 22 adjacent the input section 14. The stack 22 is frequently contained a stack container or bin 24. The fanfold paper 20 has sheets or panels 26 between fold or crease lines 28. Most frequently the fold lines 28 are located at transverse perforations that are formed at prescribed intervals to form the sheets or panels 26 therebetween.

The continuous form printer 12 at the input section 14 includes an optional input guide 30 for guiding the paper from the stack 22 into the printer 12. An output guide 32 is mounted at the output section 16 for directing paper discharge from the printer in a downward orientation illustrated in FIGS. 4–6.

The collector 10 includes a frame 40 having a base 41 that is generally floor mounted. The frame 40 includes a printer stand section 42 that extends upward from the base 41 to support the printer 12. The base 41 includes a restacking section 44 with a restack platform 46. The platform 46 has a paper break element 48.

The restacking section 44 further includes opposing side walls 50 and 52 that are positioned for receiving the restack of the fanfold paper 20. Although not illustrated, the side walls 50 and 52 may be adjusted with respect to each other to accommodate different length sheets 26. The restacking section 44 also includes a back wall 54 and a front opening to permit a restack of the fanfold paper to be removed as necessary.

Figure 3:
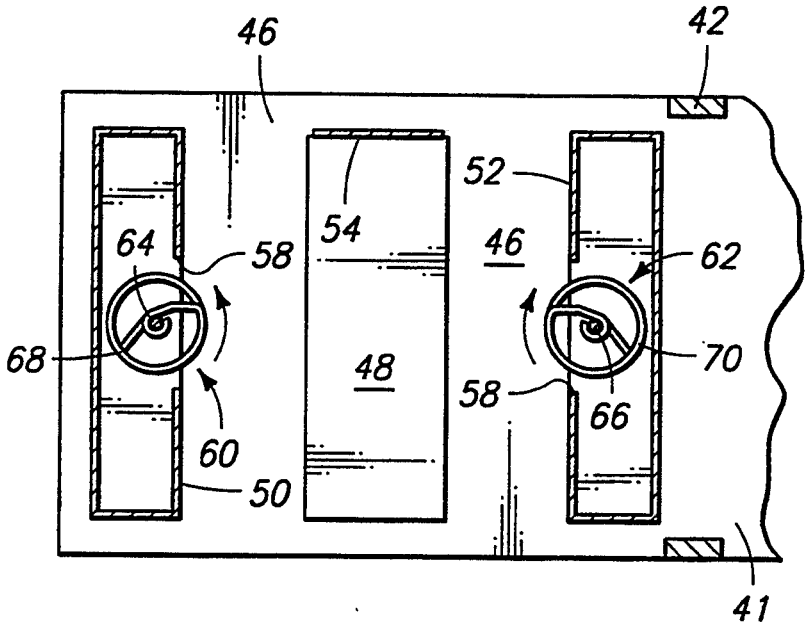
FIG. 3 is a fragmentary horizontal cross sectional view taken along line 3—3 in FIG. 2.

Each of the side walls 50 and 52 have vertical slots 58 formed therein (FIG. 3).

Figure 7:
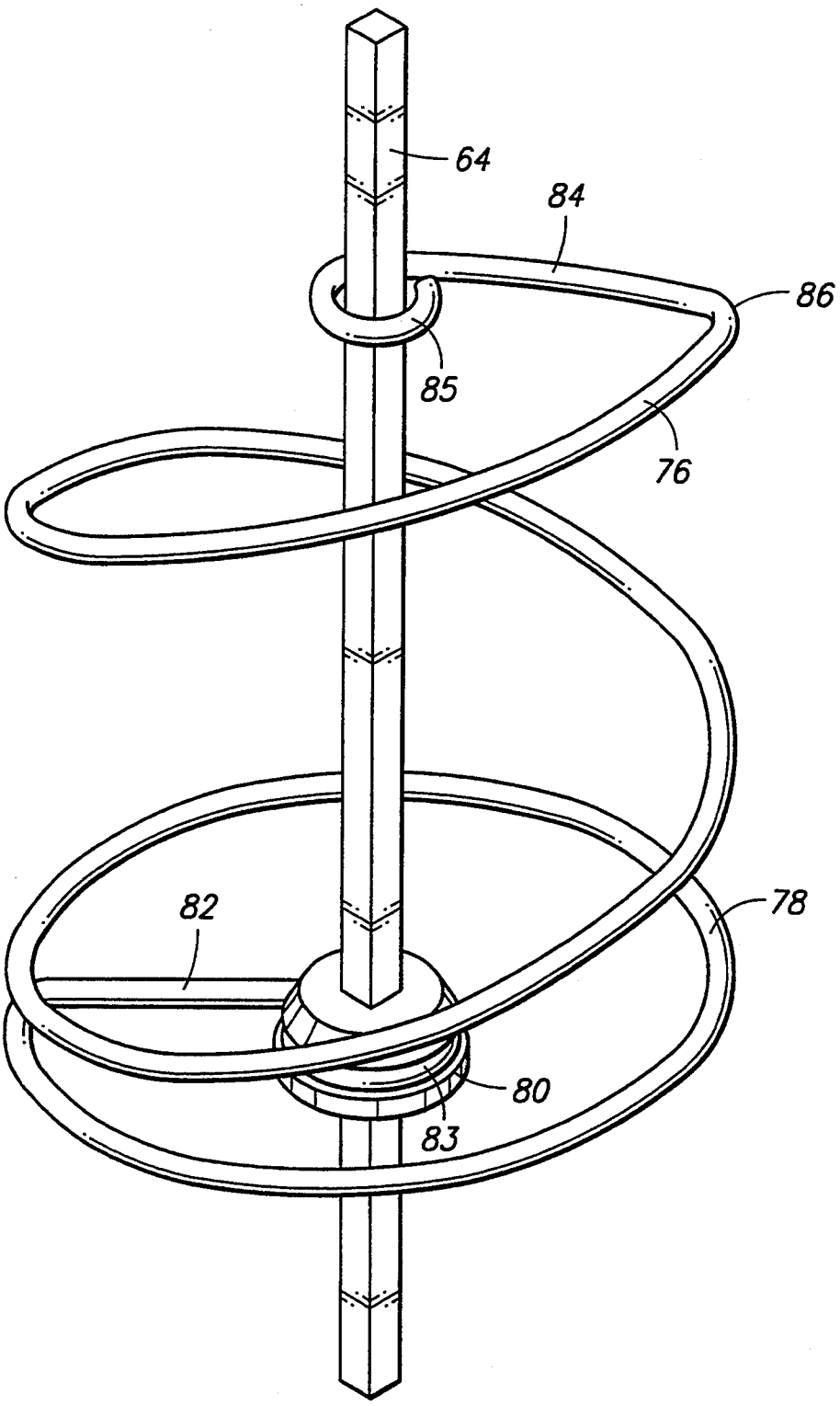
FIG. 7 is an enlarged isometric view of one of the helical guide and stacking devices, illustrated in FIGS. 4–6.

Helical refolding guides 60 and 62 are mounted in the vertical slots 58 of respective side walls 50 and 52 for refolding and restacking the fanfold paper 20 discharged from the output section 16 of the printer 12. The helical refolding guides 60 and 62 are mounted on upright shafts 64 and 66, respectively, that are rotated in opposite directions about substantially vertical parallel axes. Preferably each of the shafts 64 and 66 have a square cross-section. The helical refolding guide 60 includes a helical screw that has a right-hand thread helical spiral element 68. The helical refolding guide 62 includes a helical screw having a left-hand thread helical spiral element 70. Preferably, each of the spiral elements 68 and 70 are formed of a wire bent in helical spiral. Each of the spiral elements 68 and 70 have variable pitches with an upper convolution 76 and a lower convolution 78 as illustrated in FIG. 7.

Although each of the helical spiral elements 68 and 70 are illustrated with a cylindrical spiral shape, alternatively each of the helical screw elements 68 and may be formed with a conical spiral shape. The spiral elements 68 and 70 are mounted on the respective shafts 64 and 66 with friction support elements 80 in the form of bushings. Preferably, the bushings 80 have square shaped apertures to accommodate the square shafts. The friction support element 80 permits the helical elements 68 and 70 to slide vertically along the shafts 64 and 66 as the shafts are rotated. In one embodiment, the bushings 80 loosely engage the shafts 64 and 66 so that the spiral elements 68 and 70 will fall by gravity until the lower convolution 78 engages a firm surface. In an alternative configuration, the friction support element 80 engages the shafts 64 and 66 with sufficient friction that the helical elements 68 and 70 will remain vertically stationary on the shafts until a small force is applied, either upward or downward, to adjust the position of the helical elements 68 and 70 on the shafts 64 and 66, respectively.

Each of the helical elements 68 and 70 have an upper radial arm 84 (FIG. 7) that extends outward from an upper loop 85 to the upper convolution 76 defined by an elbow 86. A lower radial arm 82 extends outward from a lower loop 83 that is mounted on the bushing support 80.

Figure 4:
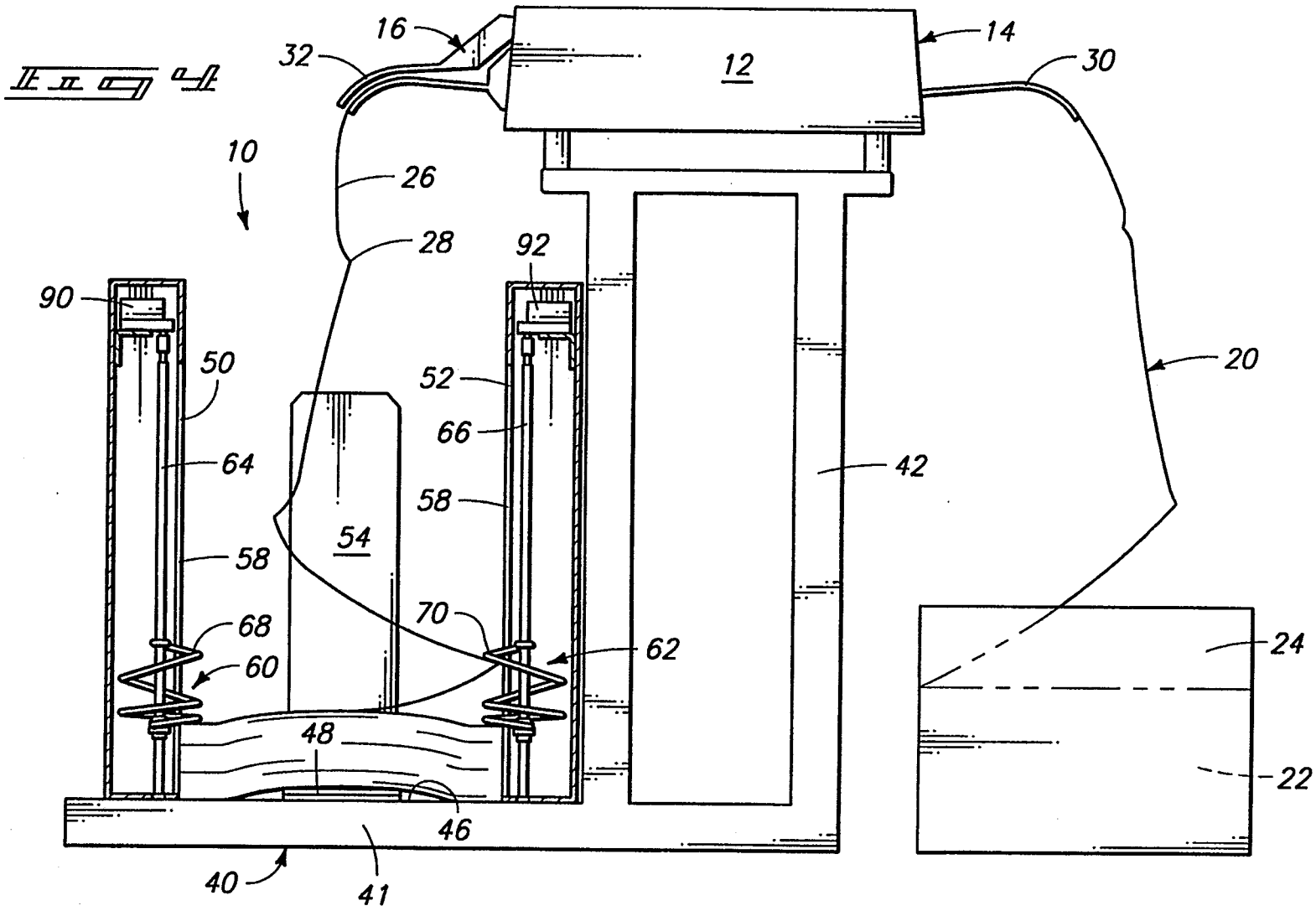
FIG. 4 is a side elevational view similar to FIG. 2, except showing the flow of fanfold paper through the printer and being refolded by a helical guide and stacking device.
Figure 5:
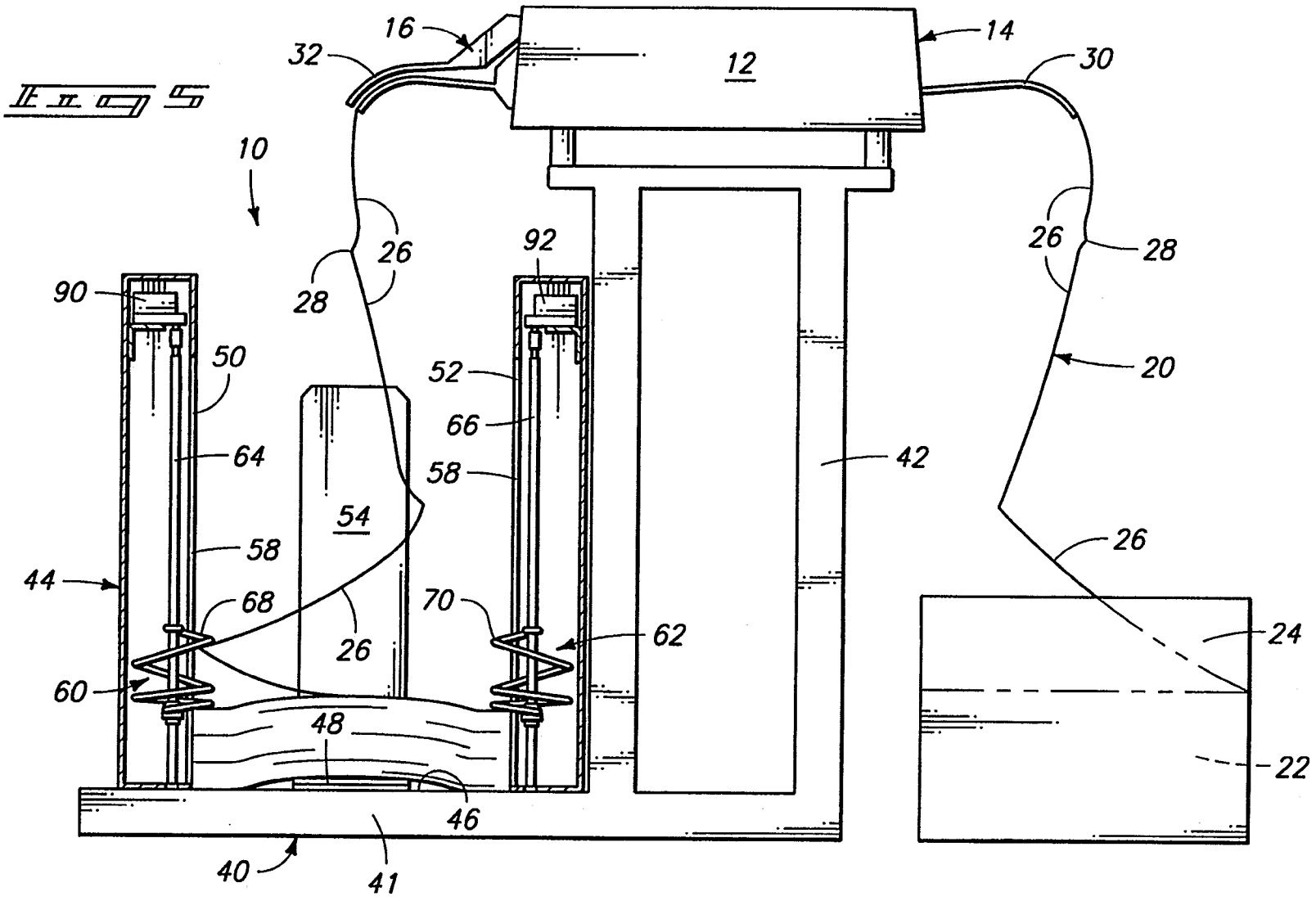
FIG. 5 is a side elevational view similar to FIG. 4, except showing the fanfold paper being refolded by a second opposing helical guide and stacking device.
Figure 6:
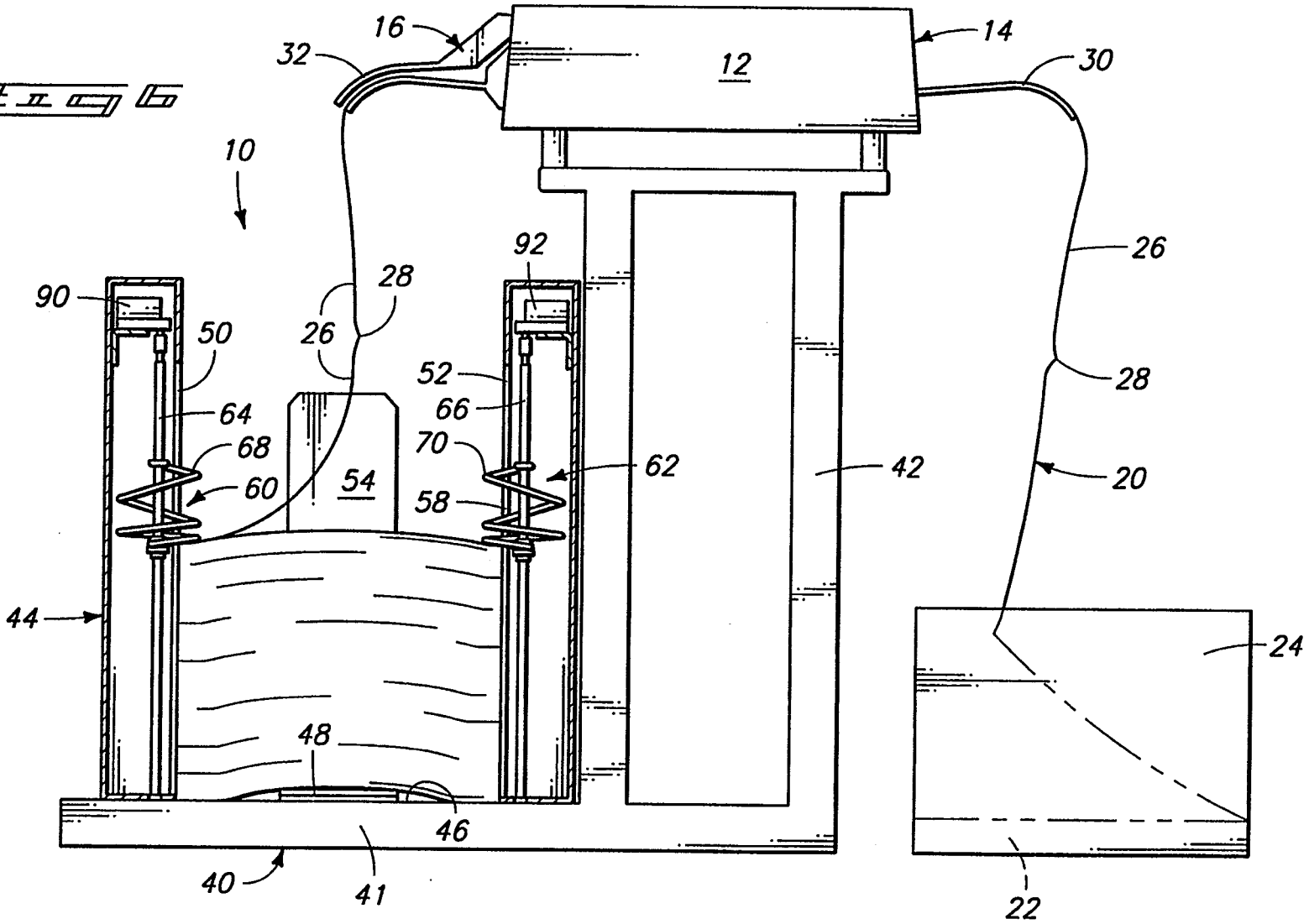
FIG. 6 is a side elevational view similar to FIG. 5, except showing the migration of the helical guide and stacking devices upwardly as the stack increases in height.

The shafts 64 and 66 are rotated in opposite directions by motors 90 and 92 respectively (FIGS. 4–6). As viewed in FIG. 3, shaft 64 is rotated in a counterclockwise direction, and shaft 66 is rotated in a clockwise direction to cause the helical elements 68 and 70 to engage and to bias the fanfold paper 20 downward and laterally against the back wall 54.

Alternatively, the spiral elements 68 and 70 may be both formed with a right-hand thread or a left-hand thread.

As illustrated in FIGS. 4–6, the fanfold paper, as it descends from the output guide 32, initially engages one of the helical elements 68 or 70. In FIG. 4, the fanfold paper is initially engaged by elbow 86 of the helical element 70. The helical element 70 guides the fanfold paper downward towards the platform 46 and against the back wall 54, and progressively refolds the fanfold paper along the fold line 28. As the helical element 70 revolves, the fold line progressively moves along the upper convolution 76 to the lower convolution 78. The fold line 28 then is deposited on the restack with the lower convolution 78 riding on the succeeding sheet to restack the fanfold paper 20.

As the fanfold paper further descends, a subsequent fold line 28 is engaged by the helical element 68 (FIG. 5), and is likewise moved downward along the upper convolution 76 to the lower convolution 78 and onto the restack. This process is continued as the paper passes through the printer 12 to refold and restack the fanfold paper. As the helical elements 68 and 70 rotate, they continually move vertically upward with the lower convolution 78 riding on the top of the restack and the upper convolution 76 projecting above the restack to receive a succeeding fold line 28.

FIG. 6 illustrates the upward movement of the helical elements 68 and 70 as the height of the restack is increased. Consequently, the helical elements 68 and 70 not only rotate about their axes by the rotation of the shaft 64 and 66, but additionally move vertically upward as the restack is being formed. The helical elements 68 and 70 in addition to refolding the fanfold paper, restacks and applies downward pressure on the edge of the stack to provide some stack compression.

As illustrated in FIGS. 3 and 7, the shafts 64 and 66 preferably have a square cross-section to facilitate the rotation of the helical elements 68 and 70 about their axes while permitting the helical elements 68 and 70 to slide vertically along the shafts to maintain the helical elements 68, 70 on the top of the stack.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A printer output paper collector for refolding and restacking fanfold paper discharged from a continuous form printer or the like, in which the fanfold paper has fold lines at prescribed intervals, comprising:

a platform for receiving and supporting a reformed stack of fanfold paper discharged from the continuous form printer;

opposing helical refolding guides on opposite sides of the platform that are movably mounted for (1) rotation about substantially upright parallel axes, and (2) vertical movement relative to the platform;

each of said helical refolding guides having a spiral element for engaging the fanfold paper discharged from the continuous form printer and refolding the fanfold paper at the fold lines;

rotating drive means operatively connected to the helical refolding guides for rotating the helical refolding guides about the upright parallel axes to (1) move the spiral elements into engagement with the fanfold paper discharged from the continuous form printer, and (2) guide the fanfold paper downward toward the platform to progressively refold the fanfold paper along the fold lines, and (3) restack the fanfold paper on the platform with the height of the reformed stack progressively increasing on the platform; and vertical movement means for permitting the helical refolding guides to progressively move vertically relative to the platform as the height of the stack increases to maintain the spiral elements on top of the reformed stack to engage the fanfold paper discharged from the output of the printer.

2. The printer output paper collector as defined in claim 1 wherein each of the spiral elements have a varying helical angle.

3. The printer output paper collector as defined in claim 1 wherein the rotating drive means includes vertically oriented shafts that rotate about the upright parallel axes and wherein the vertical movement means includes bushings movably mounted on the shafts for permitting the opposed helical refolding guides to progressively move upward as the restack height increases to maintain the helical refolding guides on top of the restack as it is being formed.

4. The printer output paper collector as defined in claim 1 wherein each of the spiral elements has an upper convolution for initially engaging the fanfold paper and refolding the paper at a fold line and a lower convolution that rides on top of the restack and vertically compresses the restack.

5. The printer output paper collector as defined in claim 4 wherein each of the spiral elements has a varying helical angle between the upper and lower convolutions.

* * * * *